United States Patent [19]

Schneider

[11] Patent Number: 4,819,402

[45] Date of Patent: Apr. 11, 1989

[54] STRUCTURAL ELEMENT FOR CONSTRUCTIONAL SYSTEMS

[76] Inventor: Siegfried Schneider, Turnerstrasse 22, D-5650 Solingen 13, Fed. Rep. of Germany

[21] Appl. No.: 142,529

[22] Filed: Jan. 11, 1988

[30] Foreign Application Priority Data

Jan. 31, 1987 [DE] Fed. Rep. of Germany ... 8701515[U]

[51] Int. Cl.[4] ..... E04C 3/36; E04C 3/32

[52] U.S. Cl. ..... 52/726; 403/359; 52/648; 52/738

[58] Field of Search ..... 52/646, 648, 726, 726, 52/738, 740; 403/359; 29/465, 525

[56] References Cited

U.S. PATENT DOCUMENTS 1,779,805 10/1930 Dunwoodie ..... 29/465

FOREIGN PATENT DOCUMENTS 431683 3/1948 Italy ..... 403/359
8402560 7/1984 PCT Int'l Appl. ..... 403/359
375231 6/1932 United Kingdom ..... 403/359
1495565 12/1977 United Kingdom ..... 403/359

*Primary Examiner*—James L. Ridgill, Jr.
*Attorney, Agent, or Firm*—Pearne, Gordon, McCoy & Granger

[57] ABSTRACT

A structural element for constructional systems, for example for building frames, comprises a rod-shaped basic body having first and second ends and a respective plug of profiled cross-section on each of said ends which fit into a respective blind hole and the ends of a further structural element which can be a rod-like element.

4 Claims, 2 Drawing Sheets

STRUCTURAL ELEMENT FOR CONSTRUCTIONAL SYSTEMS

Figure 1:
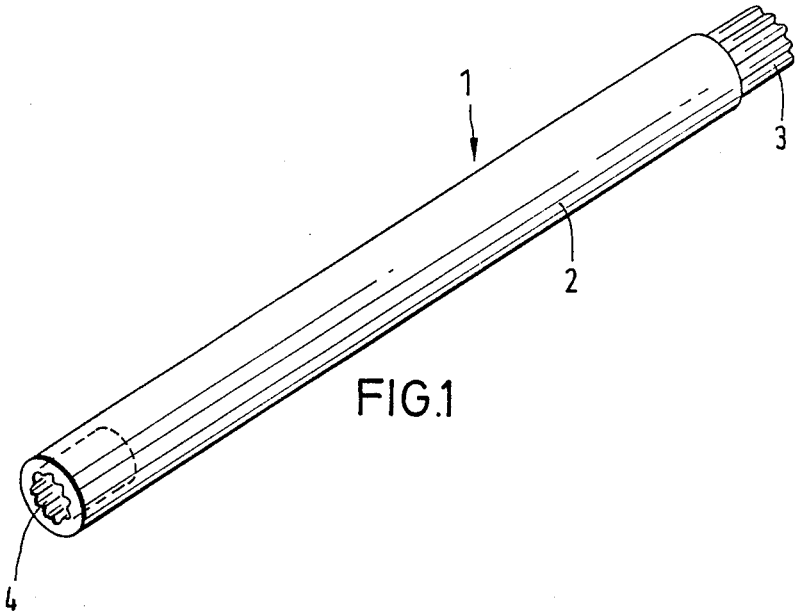

The invention relates to a structural element for structural systems, for example for building frames. In this connection one can think both of climbing or scaffold frames and also frames for the construction of toys.

Frames are currently built up from rods or bars arranged both vertically and horizontally. These components are connected together and secured to one another by means of screws inserted through appropriate holes on or in the elements and secured in the assembled position by the use of nuts. Such frames are not only expensive but also required a lot of manual work in assembly and disassembly.

The object of the invention is to provide a simply constructed and also simply and conveniently used structural element for structural systems, for examples for building frames, which is easy to handle and in particular requires little manual effort when one builds, for example, a frame from such elements.

This problem is solved according to the invention by a structural element which comprises a rod-like or bar-like basic component on each of the two ends of which is a respective plug of profiled cross-section. In contrast to known frames it is possible with the element according to the invention, to build up any desired frame or the like by simple plug-in connections, the plug connection generally being sufficient to join the individual components of such a frame or other structural system sufficiently rigidly together.

According to a preferred advantageous embodiment of the invention the profile of the cross-section of the plug has eight corners. Such a profile allows a good positively keyed connection between the individual structural elements which are plugged together and the plug can be constructed both as a male or a female component, i.e. either a plug-in element or a socket shaped to receive such an element. On the basis of the eight-cornered form of the cross-section the elements according to the invention can be rapidly fitted together in a simple manner and without having to take care with regard to how accurately they are positioned relatively to one another.

According to a further feature of the invention the profiled cross-section of the plug has a lightly wavy contour. Such a contour has the advantage that it can be manufactured by an injection process from plastics using relatively simple tools as the tools do not have to have any undercuts. On the other hand it has been found that such a cross-section is sufficient in order to achieve a positively keyed plug connection of sufficient strength. In such an arrangement the tolerances between the co-operating profiles can be chosen so that a sufficiently permanent positive plug connection is achieved based on friction alone, and this achieves the result that structures such as frames built up from such elements are held together with adequate stability.

According to a further feature of the invention rod-shaped or bar-shaped projections could be provided on the rod-like or strut-like basic component of the construction or element according to the invention, extending radially with respect to the element, and each being provided with a plug at its outer end. Such elements can be used as a corner connectors for the frame structure or for joining together several simple rod-like or strut-like basic bodies or structural elements.

Although it is of particular advantage to manufacture the element according to the invention from plastics, preferably by injection moulding, it could also be made of other materials such as metal.

Figure 2:
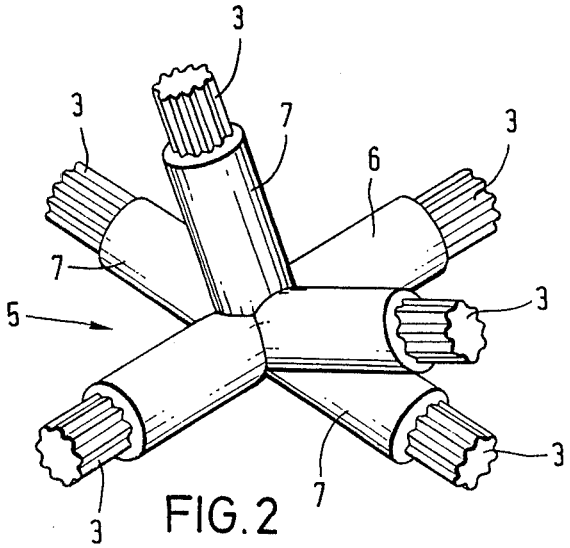
Figure 3:
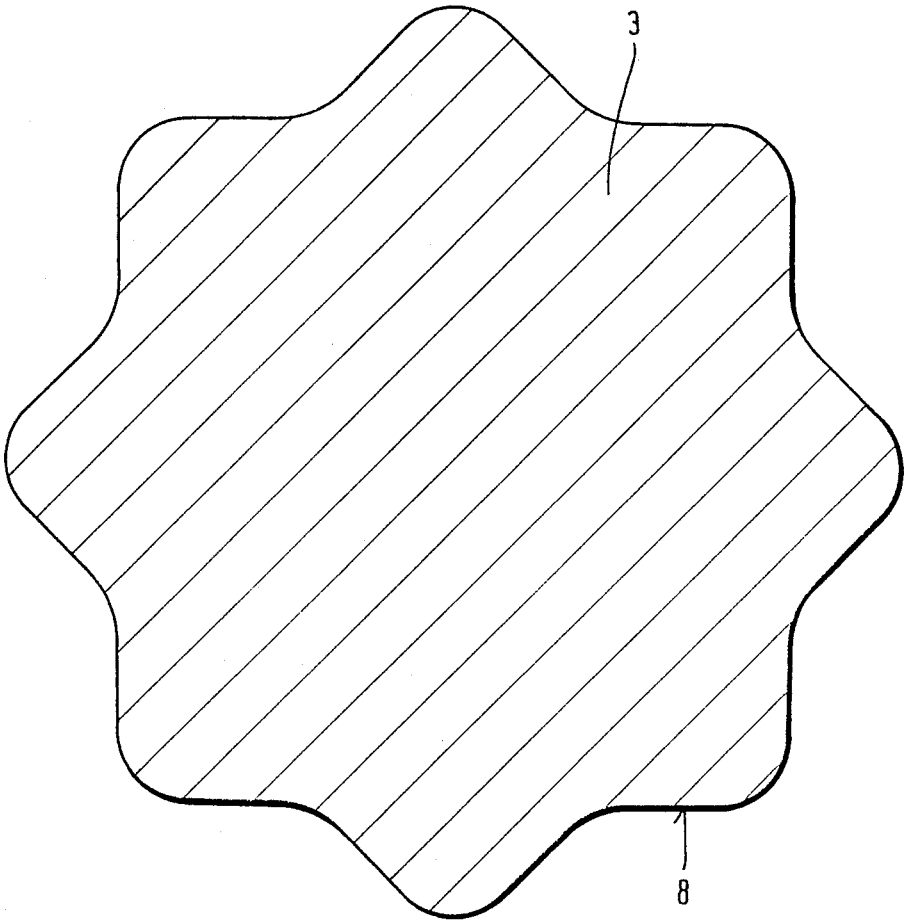

Two embodiments by way of example of the structural element according to the invention are illustrated in the drawing, in which:

FIG. 1 is a perspective view of a rod-shaped element which has a male plug at one end and a female socket at the other end, in which can be inserted a male plug of another similar structural element, FIG. 2 is a perspective view of another structural element with several radially extending projections, all parts having a male plug on their ends, and FIG. 3 is a section to a larger scale of the profile of the plug according to the invention, showing the wavy shape of the contour of this plug.

The structural element 1 illustrated in FIG. 1 has a rod-like basic body 2 on the one end of which there is provided a male plug 3 with a profiled cross-section, while the other end contains a female plug or blind hole 4 which has the same contour as the plug 3 and accordingly is suitable and designed for insertion of the plug 3 of a corresponding or similarly constructed structural element.

The cross-sectional shape of the plug 3 and the blind hole 4 is illustrated in detail in FIG. 3 and will be further explained below.

The structural element 5 in FIG. 2 likewise has a rod-shaped base body 6 on the two ends of which are arranged a respective male plug 3. In addition, at about the central region of the body 6 there are radially extending rod-shaped projections 7, four such projections altogether in the embodiment illustrated, each of these projections 7 having on its outer end a male plug 3. This structural element 5 is suitable for forming a corner connection or node for a frame, whereby structural elements 1 of the kind illustrated in FIG. 1 can be joined at these nodes, in that one fits these rod-shaped structural elements with their blind holes 4 on the plugs 3 of the element 5.

Although in the element shown in FIG. 1 there is a male plug 3 on the one end and a blind hole 4 on the other end, i.e. a female socket, the element 1 could be made of the same form at both ends. Likewise it is possible, in the element 5 shown in FIG. 2, to provide female sockets in the form of blind holes 4 on the ends of the rod-like basic body 6 and the projections 7 instead of the male plugs 3 illustrated. One would select the appropriate version for the particular purpose required.

FIG. 3 shows that the plug 3 has in cross-section an approximately eight-cornered contour, the contour 8 extending in the form of low-profile waves, in order to avoid undercuts.

The contour 8 comprises eight-lobular projections of equal size and spacing provided by a series of alternating convex and concave arcs joined by relatively short tangentially extending straight portions to result in a flat, wavy contour. The blind holes 4 have a corresonding contour so that the plugs 3 fit into the blind holes 4. In this connection it is to be observed that the contour has no undercuts, and so the profile can be manufactured, for example from plastics by injection moulding, using relatively simple tools.

I claim:

1. Structural element for constructional systems, for example for building frames, said element comprising a rod-shaped basic body having first and second ends and a respective plug of eight-cornered profiled cross-section on each of said ends, said plugs being either male or female and of the same profiled cross-section.

2. The structural element set forth in claim 1 wherein the profile of said profiled cross-section of said plug has a flat wavy contour.

3. The structural element set forth in claim 1 further comprising rod-shaped projections on the basic body, each said projection having a free end, and a respective plug on each said free end.

4. The structural element set forth in claim 1, wherein said eight-cornered profiled cross-section comprises eight-lobular projections of equal size and spacing provided by a series of alternating convex and concave arcs joined by relatively short tangentially extending straight portions to result in a flat, wavy contour.

* * * * *